US009492827B2

(12) United States Patent
Daniels et al.

(10) Patent No.: US 9,492,827 B2
(45) Date of Patent: Nov. 15, 2016

(54) ROLL ASSEMBLIES INCLUDING SUPERHARD INSERTS, HIGH PRESSURE GRINDER ROLL APPARATUSES USING SAME, AND METHODS OF USE

(71) Applicant: US SYNTHETIC CORPORATION, Orem, UT (US)

(72) Inventors: Grant Kyle Daniels, Spanish Fork, UT (US); Regan Leland Burton, Saratoga Springs, UT (US)

(73) Assignee: US SYNTHETIC CORPORATION, Orem, UT (US)

( * ) Notice: Subject to any disclaimer, the term of this patent is extended or adjusted under 35 U.S.C. 154(b) by 121 days.

(21) Appl. No.: 14/266,353

(22) Filed: Apr. 30, 2014

(65) Prior Publication Data

US 2014/0326811 A1 Nov. 6, 2014

Related U.S. Application Data

(60) Provisional application No. 61/818,076, filed on May 1, 2013.

(51) Int. Cl.

| | |
|---|---|
| ***B02C 4/00*** | (2006.01) |
| ***B02C 4/30*** | (2006.01) |
| ***B02C 4/08*** | (2006.01) |
| ***B02C 4/02*** | (2006.01) |

(52) U.S. Cl.

CPC ..... *B02C 4/305* (2013.01); *B02C 4/02* (2013.01); *B02C 4/08* (2013.01)

(58) Field of Classification Search

CPC ..... B02C 4/02; B02C 4/305; B02C 2210/02

USPC ..... 241/294, 300

See application file for complete search history.

(56) References Cited

U.S. PATENT DOCUMENTS

| | | | | | |
|---|---|---|---|---|---|
| 139,105 | A | * | 5/1873 | Barr | B02C 2/10 241/294 |
| 412,558 | A | * | 10/1889 | Stephens | B02C 1/10 241/294 |
| 4,074,737 | A | * | 2/1978 | Stewart | B23C 5/04 144/117.1 |
| 4,848,683 | A | * | 7/1989 | Kawatsu | B02C 2/005 241/294 |

(Continued)

FOREIGN PATENT DOCUMENTS

| | | |
|---|---|---|
| DE | 202010013735 | 1/2012 |
| WO | WO 2005/005048 | 1/2005 |
| WO | WO 2011/072754 | 6/2011 |

OTHER PUBLICATIONS

U.S. Appl. No. 13/027,954, filed Feb. 15, 2011, Miess et al.

(Continued)

*Primary Examiner* — Faye Francis

(74) *Attorney, Agent, or Firm* — Dorsey & Whitney LLP

(57) ABSTRACT

Embodiments of the invention are directed to roll assemblies configured to exhibit improved wear resistance of stud elements. Accordingly, the roll assemblies of may improve and/or increase the useful life of high pressure grinding roll apparatuses. In an embodiment, one or more stud elements may include superhard material, which may provide superior wear resistance characteristics and may increase the useful life of the rolls assemblies and high pressure grinding roll apparatuses.

14 Claims, 5 Drawing Sheets

(56) References Cited

U.S. PATENT DOCUMENTS

| | | | | |
|---|---|---|---|---|
| 5,255,860 | A * | 10/1993 | Timmons | B02C 4/12 241/280 |
| 5,269,477 | A * | 12/1993 | Buchholtz | B02C 4/305 241/293 |
| 5,967,431 | A * | 10/1999 | Stafford | B02C 2/005 241/207 |
| 7,451,944 | B2 * | 11/2008 | Hall | B02C 2/005 241/207 |
| 7,510,135 | B2 * | 3/2009 | Burchardt | B02C 4/305 241/294 |
| 7,866,418 | B2 | 1/2011 | Bertagnolli et al. | |
| 7,998,573 | B2 | 8/2011 | Qian et al. | |
| 8,034,136 | B2 | 10/2011 | Sani | |
| 8,236,074 | B1 | 8/2012 | Bertagnolli et al. | |
| 8,434,707 | B2 * | 5/2013 | Tada | B02C 4/02 241/187 |
| 8,439,287 | B2 * | 5/2013 | Matsuzaki | B02C 4/305 241/187 |
| 8,517,295 | B2 * | 8/2013 | Matsuzaki | B02C 4/305 241/187 |
| 2003/0146318 | A1 | 8/2003 | Condon | |
| 2008/0210798 | A1 * | 9/2008 | Hall | A47C 3/00 241/294 |
| 2011/0259983 | A1 | 10/2011 | Botto et al. | |
| 2012/0048976 | A1 * | 3/2012 | Hofmann | B02C 4/305 241/230 |
| 2012/0104127 | A1 | 5/2012 | Matsuzaki et al. | |
| 2012/0312907 | A1 * | 12/2012 | Gronvall | B02C 4/305 241/30 |
| 2013/0284840 | A1 * | 10/2013 | Packeisen | B02C 4/305 241/235 |
| 2013/0299618 | A1 * | 11/2013 | Sharman | B02C 1/10 241/300 |
| 2014/0183291 | A1 * | 7/2014 | Frangenberg | B02C 4/305 241/294 |
| 2014/0291428 | A1 * | 10/2014 | Sharman | B02C 4/305 241/278.1 |

OTHER PUBLICATIONS

U.S. Appl. No. 13/100,388, filed May 4, 2011, Jones et al.

U.S. Appl. No. 13/275,372, filed Oct. 18, 2011, Mukhopadhyay et al.

U.S. Appl. No. 61/818,076, filed May 1, 2013, Daniels et al.

International Search Report and Written Opinion from International Application No. PCT/US2014/036177 mailed Sep. 17, 2014.

* cited by examiner

ROLL ASSEMBLIES INCLUDING SUPERHARD INSERTS, HIGH PRESSURE GRINDER ROLL APPARATUSES USING SAME, AND METHODS OF USE

CROSS-REFERENCE TO RELATED APPLICATIONS

This application claims priority to U.S. Provisional Application No. 61/818,076 filed on 1 May 2013, the disclosure of which is incorporated herein, in its entirety, by this reference.

BACKGROUND

High pressure grinding roll ("HPRG") apparatuses are commonly used for reducing the size of larger solid objects in a stock material, such as rocks, stones, and ore, into smaller pieces or particles. For instance, the HPRG apparatus may include two opposing roll assemblies that may rotate in opposite directions. Furthermore, the two opposing roll assemblies may be spaced apart by a predetermined gap therebetween. For example, ore may be fed between the roll assemblies, which may crush the ore. Specifically, as the roll assemblies rotate, the ore may enter or be forced into the gap between the roll assemblies and may be crushed in the gap by the roll assemblies. As noted above, crushing the ore may reduce the size of the solid objects included in the ore to smaller pieces or particles.

In some instances, the roll assemblies of the HPGR apparatus may include studs or other protrusions secured to a roll body. As the roll assemblies rotate, the studs may compress and crush the ore therebetween.

Manufacturers and users of HPGR apparatuses continue to seek improved roll assemblies to extend the useful life of such HPGR apparatuses.

SUMMARY

Embodiments of the invention are directed to roll assemblies configured to exhibit improved wear resistance of stud elements, HPRG apparatuses, and method of use. Accordingly, the roll assemblies may improve and/or increase the useful life of HPRG apparatuses.

In an embodiment, a roll assembly for reducing size of a stock material is disclosed. The roll assembly includes a roll body having an outer surface, and a plurality of superhard stud elements secured to the roll body. Each of the plurality of superhard stud elements includes a superhard element including a working surface. The working surfaces of the plurality of superhard stud elements at least partially define a crushing exterior of the roll assembly.

In an embodiment, a HPGR apparatus for processing a stock material is disclosed. The HPGR apparatus includes a first roll assembly including a first crushing exterior and a second roll assembly positioned adjacent to the first roll assembly to define a gap therebetween. The first roll assembly includes a first plurality of superhard stud elements each including a superhard element. The superhard element includes a first working surface, with the first working surfaces of the first plurality of superhard stud elements at least partially forming the first crushing exterior. The second roll assembly includes a second plurality of stud elements each of which includes a second working surface, with the second working surfaces of the second plurality of stud elements forming a second crushing exterior. The HPGR apparatus further includes a motor operably connected to and configured to rotate at least one of the first roll assembly or the second roll assembly.

In an embodiment, a method of processing a stock material is disclosed. The method includes rotating a first plurality of superhard stud elements about a first axis in a first direction, with each of the first plurality of superhard stud elements includes a superhard table that has a first working surface. The method further includes rotating a second plurality of superhard stud elements about a second axis in a second direction, with each of the second plurality of superhard stud elements including a superhard table that has a second working surface. The method additionally includes reducing the size of the solid object included in the stock material by contacting the stock material with the first working surfaces and/or the second working surfaces.

Features from any of the disclosed embodiments may be used in combination with one another, without limitation. In addition, other features and advantages of the present disclosure will become apparent to those of ordinary skill in the art through consideration of the following detailed description and the accompanying drawings.

BRIEF DESCRIPTION OF THE DRAWINGS

The drawings illustrate several embodiments of the invention, wherein identical reference numerals refer to identical or similar elements or features in different views or embodiments shown in the drawings.

DETAILED DESCRIPTION

Embodiments of the invention are directed to roll assemblies configured to exhibit improved wear resistance of stud elements, HPRG apparatuses, and method of use. The roll assemblies disclosed herein may improve and/or increase the useful life of HPRG apparatuses. In an embodiment, one or more stud elements may include superhard material, which may provide superior wear resistance characteristics and may increase the useful life of the rolls assemblies and HPGR apparatuses.

For example, a roll assembly may have one or more superhard stud elements, which may include superhard material. As used herein, a "superhard stud element" is a stud element including a working surface that is made from a material exhibiting a hardness that exceeds the hardness of tungsten carbide. In any of the embodiments disclosed herein, the superhard bearing elements may include one or more superhard materials, such as polycrystalline diamond, polycrystalline cubic boron nitride, silicon carbide, tungsten carbide, or any combination of the foregoing superhard materials. In an embodiment, the superhard stud elements may include a substrate and a superhard material bonded to the substrate.

In some embodiments, the roll assembly may include a plurality of superhard stud elements secured to a roll body, as further described below. In an embodiment, the roll body may be substantially cylindrical and may have a length and a diameter that may vary from one embodiment to the next and may depend on the particular application. Furthermore, the superhard stud elements may be located on the roll body in any number of suitable configurations and patterns and may, collectively, form or define a crushing exterior of the roll assembly. For instance, the roll body may include multiple rows of superhard stud elements, and such rows may surround substantially the entire circumference of the roll body.

Figure 1:
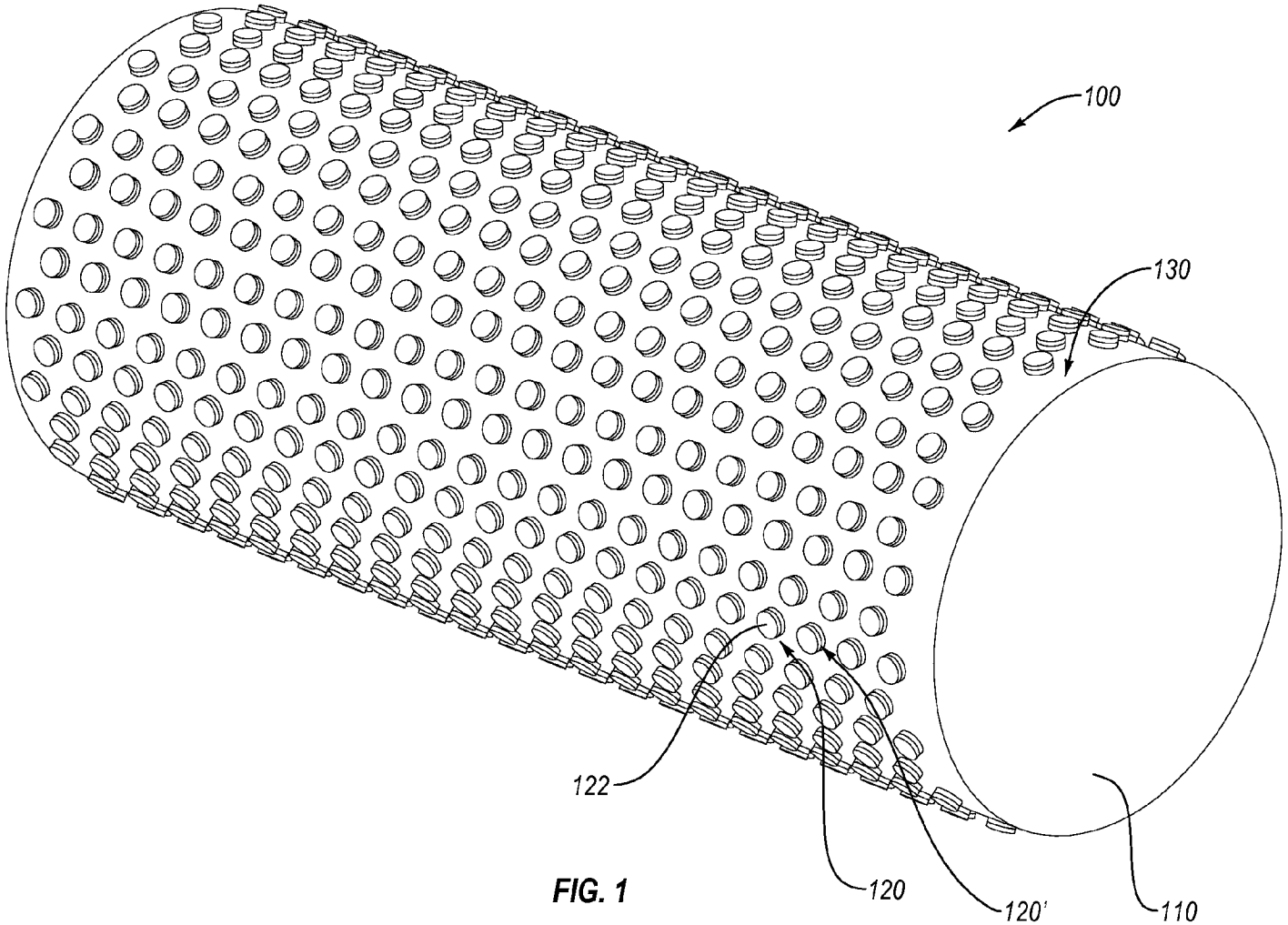
FIG. 1 is an isometric view of a roll assembly according to an embodiment.

FIG. 1 illustrates an embodiment of a roll assembly 100 that may include a roll body 110 and crushing exterior formed by and/or on the roll body 110. The superhard crushing exterior of the roll body 110 may reduce the size of the solid objects that comprise stock material by compressing, crushing, shearing, shredding, and/or grinding, solid objects included in the stock material. For ease of description, reference will be made to a "crushing exterior." It should be appreciated that the crushing exterior of the roll body 110 may compress the stock material, crush the stock material, shear the stock material, shred the stock material, grind the stock material, or combinations thereof, as may be suitable for a particular application, which may vary from one embodiment to another.

In an embodiment, the crushing exterior may be formed by one or more protrusions such as superhard stud elements 120. More specifically, one, some, or all of the superhard stud elements 120 may include superhard material that may have a working surface 122. As used herein, the term "working surface" is intended to mean any surface of the stud element that contacts the stock material. Accordingly, the crushing exterior also may include superhard material. In particular, as noted above, the superhard material may include polycrystalline diamond which may provide superior wear resistance for the crushing exterior and may improve and/or extend the useful life of the roll assembly 100. It should be noted that all or only some of the superhard stud elements 120 may comprise polycrystalline diamond. For example, other ones of the superhard stud elements (e.g., every other one, two, or three superhard stud element(s)) may be a tungsten carbide stud element 120'.

In an embodiment, the roll body 110 may have an outer surface 130, which may have a substantially cylindrical shape. It should be appreciated, however, that the shape of the outer surface 130 may vary from one embodiment to the next. For example, the outer surface 130 may have oval or other non-cylindrical shapes. In addition, the roll body 110 may be solid, hollow, or tubular (e.g., the roll body 110 may have a cored-out inner cavity or space). In any event, the roll body 110 may have sufficient strength and rigidity to compress, crush, shear, shred, and/or grind the stock material, as may be suitable for a particular application.

Similarly, the crushing exterior may approximate a cylindrical shape (e.g., the crushing exterior formed by the working surfaces 122 of the superhard stud elements 120 may lay approximately along an exterior of an imaginary cylinder). For instance, the superhard stud elements 120 may be mounted about the cylindrical roll body 110. As such, the working surface 122, collectively, may form an approximately cylindrical crushing exterior. It may be appreciated that the particular shape of the crushing exterior formed by the superhard stud elements 120 may depend on the shape of the working surfaces 122 as well as on the orientation of the superhard stud elements 120 relative to the roll body 110. In any case, the working surface 122 may have a suitable shape and orientation to form the crushing exterior that may compress, crush, and/or shear the stock material.

In an embodiment, the roll body 110 may include recesses in the outer surface 130 thereof, which may receive and accommodate the superhard stud elements 120. For example, the superhard stud elements 120 may be at least partially secured to roll body 110 (e.g., within corresponding recesses) via brazing, press-fitting, threadedly attaching, fastening with a fastener, combinations of the foregoing, or another suitable technique. In particular, the superhard stud elements 120 may be sufficiently secured to the roll body 110, such as to withstand normal operating forces experience thereby.

Furthermore, in an embodiment, the recesses may at least partially orient the superhard stud elements 120 relative to the roll body 110. For instance, the superhard stud elements 120 may have an approximately cylindrical shape, which may be oriented within circular recesses. Particularly, the superhard stud element 120 may be oriented approximately perpendicular to a tangent of the outer surface 130 at the location of the recess. In other words, the superhard stud elements 120 may be approximately radially aligned with a center of the roll body 110.

Moreover, the superhard stud elements 120 may have any number of suitable patterns and/or configurations on the roll body 110, which may vary from one embodiment to the next. For example, as mentioned above, the superhard stud elements 120 may form rows along the roll body 110, and such rows may surround the circumference of the cylindrical roll body 110. In addition, the rows may be aligned with one another (i.e., the superhard stud elements 120 in one row may be aligned with the superhard stud elements 120 and the adjacent row). Alternatively, the rows may be offset from one another, such that the superhard stud elements 120 in one row are offset from the superhard stud elements 120 in an adjacent row along the length of the roll body 110.

Also, the rows of the superhard stud elements 120 may be approximately oriented along the length of the roll body 110. Accordingly, rotation of the roll body 110 about a center axis thereof may produce rotation of the row of the superhard stud elements 120 about the center axis of the roll body 110. In additional or alternative embodiments, the row of the superhard stud elements 120 may be skewed relative to the length of the roll body 110 (i.e., the row of the superhard stud elements 120 may approximately form a spiral about the outer surface 130 of the roll body 110). Consequently, in at least one embodiment, the row of the superhard stud elements 120 may have an approximately spiral rotation relative to the center axis of the roll body 110. In any event, the crushing exterior of the roll assembly 100 may rotate about the center axis of the roll body 110 and may compress, crush, shear, shred, grind, or combinations thereof the solid objects of the stock material.

Although in some embodiments the superhard stud elements 120 may form one or more rows on the roll body 110, it should be appreciated that embodiments of the invention need not be so limited. More specifically, the superhard stud elements 120 may form any number of patterns, which may vary from one embodiment to the next. For example, the superhard stud elements 120 may form irregular patterns or may be randomly located or positioned (i.e., without any particular pattern) on the roll body 110. In other embodiments, the superhard stud elements 120 may form regular patterns and may be intermixed with non-superhard studs (e.g., tungsten carbide studs). For example, every other or every third row on the roll body 110 may include superhard stud elements 120 and remaining rows may have tungsten carbide stud elements or other less superhard stud elements.

Furthermore, the spacing between adjacent superhard stud elements 120 also may vary from one embodiment to another. In an embodiment, some or all of the superhard stud elements 120 may be spaced sufficiently close together, such that the spacing between the adjacent superhard stud elements 120 (or in other embodiments non-superhard stud elements) is less than the size of a superhard stud element that may be located on an opposing roll assembly (described below). Alternatively, the spacing between some or all of the adjacent superhard stud elements 120 may be greater than one or more of the opposing superhard stud elements.

In an embodiment, the stock material may be compressed, crushed, sheared, shredded, ground, or combinations thereof between the crushing exterior of the roll assembly 100 and an opposing crushing exterior. As noted above, the opposing crushing exterior also may include one or more stud elements. Consequently, in an embodiment, stock material may be compressed, crushed, sheared, shredded, ground, or combinations thereof between the superhard stud elements 120 and the stud elements of the opposing crushing exterior. The superhard stud elements 120 and the opposing stud elements may be spaced in a manner that the superhard stud elements 120 and the opposing stud elements at least partially overlap one another.

In additional or alternative embodiments, at least some of the opposing stud elements may at least partially fit into spaces between the superhard stud elements 120 of the roll assembly 100. As such, the solid objects of the stock material may be compressed, crushed, sheared, shredded, ground between the opposing stud elements and the superhard stud elements 120 by pressing the solid objects into the spaces between the superhard stud elements 120, or combinations thereof. Likewise, in an embodiment, at least some of the superhard stud elements 120 may fit into spaces between the opposing stud elements, thereby compressing, crushing, shearing, shredding, and/or grinding solid objects of the stock material by pressing the solid objects into the spaces between the opposing stud elements and/or into the spaces between the superhard stud elements 120. In an embodiment, the size of the pieces or particles of a crushed material produced from the stock material may be at least partially controlled by choosing a suitable pattern and/or spacing of the superhard stud elements 120 on the roll body 110 as well as by choosing an suitable gap between the crushing exterior of the roll assembly 100 and the opposing crushing exterior of another roll assembly. As used herein, the term "crushed material" refers to the material produced from the stock material by, among other things, at least one of compressing, crushing, shearing, shredding, or grinding the stock material by and/or between the crushing exterior of the roll assembly 100 and the opposing crushing exterior. For instance, the crushed material may be produced by passing the stock material through the HPGR apparatus, as described below.

Although the opposing crushing exterior described above includes one or more opposing stud elements, it should be appreciated that embodiments of the invention are not so limited. For instance, the opposing crushing exterior may be substantially uniform (e.g., may comprise an outer surface of a roll body of an opposing roll assembly), may include welded-on ridges or spots, as well as may have any number of various configurations and features that may allow compressing and/or shearing of the stock material between the opposing crushing exterior and the crushing exterior of the roll assembly 100. Furthermore, while in one or more embodiments, the opposing crushing exterior may be included in an opposing roll assembly, in additional or alternative embodiments, the opposing crushing exterior may be secured to or integrated with a stationary component or element.

Moreover, the opposing crushing exterior may have any number of suitable shapes. In an embodiment, the opposing crushing exterior may be approximately cylindrical (i.e., similar in shape to the outer surface 130). Alternatively or additionally, the opposing crushing exterior may have a shape that approximates a portion of an inner surface of a cylindrical tube. In other embodiments, the opposing crushing exterior may be approximately planar, or arcuate. In any event, the opposing crushing exterior and the crushing exterior of the roll assembly 100 may be suitable to allow compression and/or shearing of the stock material therebetween.

In an embodiment, the roll assembly 100 and the opposing roll assembly may rotate about respective center axes, in opposite directions relative to one another. For example, the roll assembly 100 may rotate in a clockwise direction, while the opposing roll assembly may rotate in a counterclockwise direction (i.e., the crushing exterior of the roll assembly 100 and that crushing exterior of the opposing roll assembly may move in opposite directions). Moreover, the roll assembly 100 and the opposing roll assembly may rotate at approximately the same speed. Alternatively, the roll assembly 100 and the opposing roll assembly may rotate at different speeds. Furthermore, in one embodiment, the crushing exterior of the opposing roll assembly or the crushing exterior of the roll assembly 100 may remain stationary while the other of the crushing exterior of the opposing roll assembly or the crushing exterior of the roll assembly 100 may move or rotate.

In an embodiment, movement of the crushing exterior of the roll assembly 100 and the opposing crushing exterior at different speeds may facilitate shearing, shredding, grinding of the stock material, or combinations thereof. For instance, friction between the stock material and the crushing exterior of the roll assembly 100 and the opposing crushing exterior may impart compressive/shearing forces on to the stock material, which may fracture, break apart, crush the stock material, or combinations thereof as the stock material passes between the crushing exterior of the roll assembly 100 and the opposing crushing exterior. In addition, in an embodiment, the crushing exterior of the roll assembly 100 and/or the opposing crushing exterior may frictionally slip relative to the stock material located therebetween, thereby grinding or sliding against at least a portion of the stock material.

In any event, as the stock material passes between the crushing exterior of the roll assembly 100 and the opposing crushing exterior, the stock material may experience interparticle breakage that may reduce the size of the solid objects of the stock material, to smaller pieces or particles included in the crushed material. Hence, at least a portion of the pieces or particles included in the crushed material may be formed from breakage produced by tension/compression between other particles, such as between the surrounding particles, which may be distinct from single-particle breakage (e.g., breakage into two pieces of a single particle crushed between surfaces of a crushing machine).

Figure 2A:
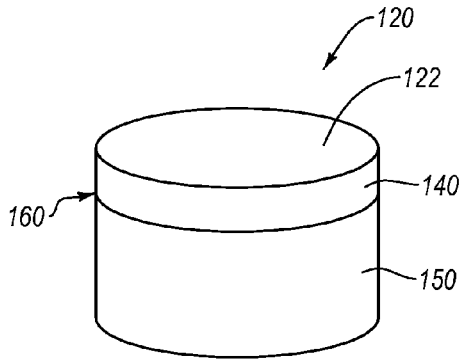
FIG. 2A is an isometric view of a superhard stud element according to an embodiment.

It should be appreciated, that the superhard stud elements 120 may include various features that may facilitate various modes of breakage and/or reduction in size of the solid objects included in the stock material. In an embodiment, as illustrated in FIG. 2A, the superhard stud element 120 may include a superhard table 140 that has an approximately planar working surface 122. The superhard table 140 may be bonded or otherwise secured to a substrate 150.

For example, the superhard table 140 may comprise polycrystalline diamond and the substrate 150 may comprise cobalt-cemented tungsten carbide. Furthermore, in any of the embodiments disclosed herein, the polycrystalline diamond table may be leached to at least partially remove or substantially completely remove a metal-solvent catalyst (e.g., cobalt, iron, nickel, or alloys thereof) that was used to initially sinter precursor diamond particles to form the polycrystalline diamond. In another embodiment, an infiltrant used to re-infiltrate a preformed leached polycrystalline diamond table may be leached or otherwise removed to a selected depth from a working surface. Moreover, in any of the embodiments disclosed herein, the polycrystalline diamond may be un-leached and include a metal-solvent catalyst (e.g., cobalt, iron, nickel, or alloys thereof) that was used to initially sinter the precursor diamond particles that form the polycrystalline diamond and/or an infiltrant used to re-infiltrate a preformed leached polycrystalline diamond table. Examples of methods for fabricating the superhard bearing elements and superhard materials and/or structures from which the superhard bearing elements may be made are disclosed in U.S. Pat. Nos. 7,866,418; 7,998,573; 8,034,136; and 8,236,074; the disclosure of each of the foregoing patents is incorporated herein, in its entirety, by this reference.

The diamond particles that may be used to fabricate the superhard table 140 in a high-pressure/high-temperature process ("HPHT") may exhibit a larger size and at least one relatively smaller size. As used herein, the phrases "relatively larger" and "relatively smaller" refer to particle sizes (by any suitable method) that differ by at least a factor of two (e.g., 30 μm and 15 μm). According to various embodiments, the diamond particles may include a portion exhibiting a relatively larger size (e.g., 70 μm, 60 μm, 50 μm, 40 μm, 30 μm, 20 μm, 15 μm, 12 μm, 10 μm, 8 μm) and another portion exhibiting at least one relatively smaller size (e.g., 15 μm, 12 μm, 10 μm, 8 μm, 6 μm, 5 μm, 4 μm, 3 μm, 2 μm, 1 μm, 0.5 μm, less than 0.5 μm, 0.1 μm, less than 0.1 μm). In an embodiment, the diamond particles may include a portion exhibiting a relatively larger size between about 10 μm and about 40 μm and another portion exhibiting a relatively smaller size between about 1 μm and 4 μm. In another embodiment, the diamond particles may include a portion exhibiting the relatively larger size between about 15 μm and about 50 μm and another portion exhibiting the relatively smaller size between about 5 μm and about 15 μm. In another embodiment, the relatively larger size diamond particles may have a ratio to the relatively smaller size diamond particles of at least 1.5. In some embodiments, the diamond particles may comprise three or more different sizes (e.g., one relatively larger size and two or more relatively smaller sizes), without limitation. The resulting polycrystalline diamond formed from HPHT sintering the aforementioned diamond particles may also exhibit the same or similar diamond grain size distributions and/or sizes as the aforementioned diamond particle distributions and particle sizes. Additionally, in any of the embodiments disclosed herein, the superhard bearing elements may be free-standing (e.g., substrateless) and/or formed from a polycrystalline diamond body that is at least partially or fully leached to remove a metal-solvent catalyst initially used to sinter the polycrystalline diamond body.

As noted above, the superhard table 140 may be bonded to the substrate 150. For instance, the superhard table 140 comprising polycrystalline diamond may be at least partially leached and bonded to the substrate 150 with an infiltrant exhibiting a selected viscosity, as described in U.S. patent application Ser. No. 13/275,372, entitled "Polycrystalline Diamond Compacts, Related Products, And Methods Of Manufacture," the entire contents of which are incorporated herein by this reference. In an embodiment, at least partially leached polycrystalline diamond table may be fabricated by subjecting a plurality of diamond particles (e.g., diamond particles having an average particle size between 0.5 μm to about 150 μm) to an HPHT sintering process in the presence of a catalyst, such as cobalt, nickel, iron, or an alloy of any of the preceding metals to facilitate intergrowth between the diamond particles and form a polycrystalline diamond table comprising bonded diamond grains defining interstitial regions having the catalyst disposed within at least a portion of the interstitial regions. The as-sintered polycrystalline diamond table may be leached by immersion in an acid or subjected to another suitable process to remove at least a portion of the catalyst from the interstitial regions of the polycrystalline diamond table, as described above. The at least partially leached polycrystalline diamond table includes a plurality of interstitial regions that were previously occupied by a catalyst and form a network of at least partially interconnected pores. In an embodiment, the sintered diamond grains of the at least partially leached polycrystalline diamond table may exhibit an average grain size of about 20 μm or less. Subsequent to leaching the polycrystalline diamond table, the at least partially leached polycrystalline diamond table may be bonded to a substrate in an HPHT process via an infiltrant with a selected viscosity. For example, an infiltrant may be selected that exhibits a viscosity that is less than a viscosity typically exhibited by a cobalt cementing constituent of typical cobalt-cemented tungsten carbide substrates (e.g., 8% cobalt-cemented tungsten carbide to 13% cobalt-cemented tungsten carbide).

Additionally or alternatively, the superhard table 140 may be a polycrystalline diamond table that has a thermally-stable region, having at least one low-carbon-solubility material disposed interstitially between bonded diamond grains thereof, as further described in U.S. patent application Ser. No. 13/027,954, entitled "Polycrystalline Diamond Compact Including A Polycrystalline Diamond Table With A Thermally-Stable Region Having At Least One Low-Carbon-Solubility Material And Applications Therefor," the entire contents of which are incorporated herein by this reference. The low-carbon-solubility material may exhibit a melting temperature of about 1300° C. or less and a bulk modulus at 20° C. of less than about 150 GPa. The low-carbon-solubility, in combination with the high diamond-to-diamond bond density of the diamond grains, may enable the low-carbon-solubility material to be extruded between the diamond grains and out of the polycrystalline diamond table before causing the polycrystalline diamond table to fail during operations due to interstitial-stress-related fracture.

In some embodiments, the polycrystalline diamond, which may comprise the superhard table 140, may include bonded-together diamond grains having aluminum carbide disposed interstitially between the bonded-together diamond grains, as further described in U.S. patent application Ser. No. 13/100,388, entitled "Polycrystalline Diamond Compact Including A Polycrystalline Diamond Table Containing Aluminum Carbide Therein And Applications Therefor," the entire contents of which are incorporated herein by this reference.

It should be appreciated that, while the above description provides specific examples of superhard table 140 and substrate 150, the embodiments of the invention are not so limited. More specifically, the superhard stud elements 120 may include any number of suitable superhard tables and substrates, which may vary from one embodiment to the next. Furthermore, in an embodiment, the superhard stud element 120 may be substrateless, and may include only the superhard table 140 (e.g., superhard table 140 comprising polycrystalline diamond), which may be secured to the roll body, as described above.

Furthermore, in an embodiment, the working surface 122 of the superhard table 140 may be substantially smooth (i.e., without texture or patterns thereon). A smooth working surface 122 may reduce one or more of fracturing, shredding, or grinding of the stock material as the stock material passes between the opposing crushing exteriors. Accordingly, reduction of the size of the solid objects included in the stock material may occur primarily through crushing and/or inter-particle breakage of the solid objects of the stock material, which may be desirable in some applications.

In additional or alternative embodiments, at least a portion of the working surface 122 may include texture, pattern, or other features that may increase friction between the working surface 122 and the stock material. Consequently, the crushing exterior that includes such working surface 122 also may exhibit increased friction (e.g., as compared to the superhard stud element 120 that has a substantially smooth working surface 122). Thus, the crushed material produced at least in part by such crushing exterior also may include pieces created due to a textured, patterned, or nonplanar crushing surface interacting with the stock material.

The superhard table 140 may be bonded to the substrate 150 along an interface 160 (e.g., as described above). In one or more embodiments, the interface 160 may be substantially planar or flat. In additional or alternative embodiments, however, the interface 160 may include any number of suitable shapes, sizes, and configurations. For instance, the interface 160 may have a curved, grooved, textured, or recessed or otherwise nonplanar, where at least a portion of the interface 160 exhibits such a nonplanar geometry. As such, in some embodiments, the superhard table 140 may provide increased surface area that is exposed to the stock material (as compared with the surface area of the superhard table 140 that has a planar interface with the substrate 150).

Furthermore, as described above, the superhard stud element 120 may have an approximately cylindrical shape. More specifically, the superhard table 140 and the substrate 150 may have approximately cylindrical shapes that form the overall cylindrical shape of the superhard stud element 120. It should be appreciated, however, that the superhard stud element 120 may have any number of suitable shapes, such as cubic, rectangular prismoid, as well as other three-dimensional shapes. Likewise, the working surface 122 of the superhard stud element 120 also may have any number of suitable shapes that may vary from one embodiment to another, and which may affect the mechanism of breakage or reduction in size of the stock material. Any of the superhard stud elements described herein may be used or included in the roll assembly 100 (FIG. 1).

Figure 2B:
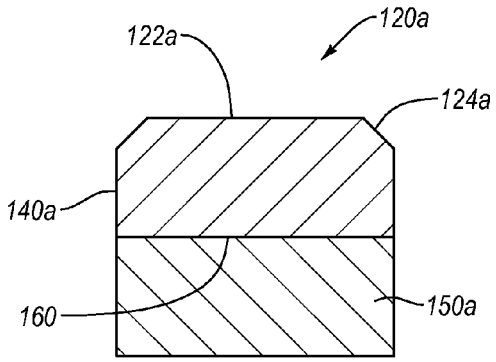
FIG. 2B is a cross-sectional view of a superhard stud element according to another embodiment.

As illustrated in FIG. 2B, an embodiment may include a superhard stud element 120*a* that includes a superhard table 140*a*, which has a working surface 122*a*. For example, the superhard table 140*a* may be bonded or secured to the substrate 150*a*. Except as otherwise described herein, the superhard stud element 120*a* and its materials, components, or elements (e.g., superhard tables) may be similar to or the same as the superhard stud element 120 (FIG. 2A) and its materials, components, or elements. An embodiment also may include a chamfer 124*a*, which may be positioned about the perimeter of the working surface 122*a*. In an embodiment, an otherwise sharp corner formed between the working surface 122*a* and the peripheral surface of the superhard table 140*a* may be ground to form the chamfer 124*a*.

For instance, as the working surface 122*a* (or the crushing exterior that includes that working surface 122*a*) makes contact with the stock material, an otherwise sharp corner may be impacted by stock material, which may chip or break the sharp corner. In addition, such impact(s) also may produce a crack, emanating from or originating at the sharp corner, which may propagate through the superhard table 140. The chamfer 124*a* may reduce such chipping, breaking, cracking, and/or combinations thereof that may occur at an otherwise sharp corner, thereby increasing and/or improving the useful life of the superhard stud element 120*a*.

Figure 2C:
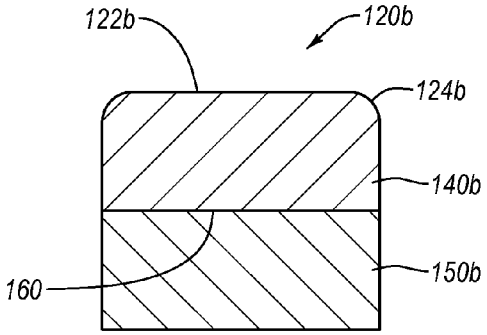
FIG. 2C is a cross-sectional view of a superhard stud element according to yet another embodiment.

As illustrated in FIG. 2C, an embodiment also may include a superhard stud element 120*b* that has a superhard table 140*b*, which includes a working surface 122*b*. Except as otherwise described herein, the superhard stud element 120*b* and its materials, components, or elements (e.g., superhard tables) may be similar to or the same as any of the superhard stud elements 120, 120*a* (FIGS. 2A-2B) and their respective materials, components, or elements. For instance, the superhard table 140*b* may be bonded or secured to a substrate 150*b*.

In addition, an embodiment may include the superhard stud element 120*b* that has a fillet or radius 124*b*, which may at least partially surround the perimeter of the working surface 122*b*. For example, an otherwise sharp corner formed between the working surface 122*b* and the peripheral surface of the superhard table 140*b* may be ground to form the radius 124*b*. Similar to the chamfer 124*a* (FIG. 2B), the radius 124*b* may reduce chipping, breaking, cracking, or combinations thereof that may occur at a sharp corner.

Figure 2D:
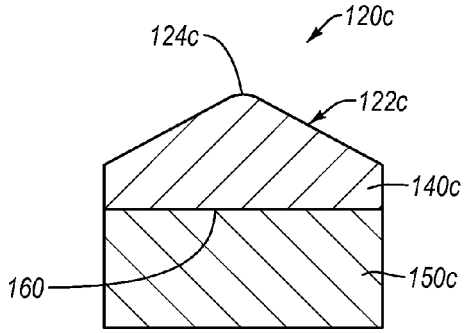
FIG. 2D is a cross-sectional view of a superhard stud element according to one other embodiment.

In additional or alternative embodiments, as illustrated in FIG. 2D, a superhard stud element 120*c* may include a superhard table 140*c* that has a conical working surface 122*c*. Except as otherwise described herein, the superhard stud element 120*c* and its materials, components, or elements (e.g., superhard tables) may be similar to or the same as any of the superhard stud elements 120, 120*a*, 120*b* (FIGS. 2A-2C) and their respective materials, components, or elements. For instance, the superhard table 140*c* may be bonded or secured to a substrate 150*c*.

The conical working surface 122*c* may also include an apex 124*c* formed at an uppermost portion of the conical working surface 122*c*. The conical working surface 122*c* may have any number of suitable angles that may vary from one embodiment to the next. Moreover, in one embodiment, the apex 124*c* may be approximately aligned with a center axis of the superhard stud element 120*c*. Alternatively, the apex 124*c* may be offset from the center axis of the superhard stud element 120*c*.

The crushing exterior (defined collectively by a plurality of stud elements attached to a roll) that includes the working surface 122*c* may have points or areas thereof that produce or apply differential force onto the solid objects of the stock material, as compared with other points or areas on the crushing exterior. More specifically, at the apex 124*c*, the distance or gap between the opposing crushing exteriors may be smaller than the gap at the lower portions of the working surface 122*c*. Consequently, the forces applied onto the solid objects of the stock material at the apex 124*c* may be greater than the forces applied onto the solid objects at other points or areas of the working surface 122*c*. In one example, the crushing exterior that has one or more conical working surface 122*c* may possibly produce crushed material that, on average, includes larger pieces or particles than the crushed material produced by the crushing exterior including the superhard stud elements with substantially flat or planar working surfaces.

Figure 2E:
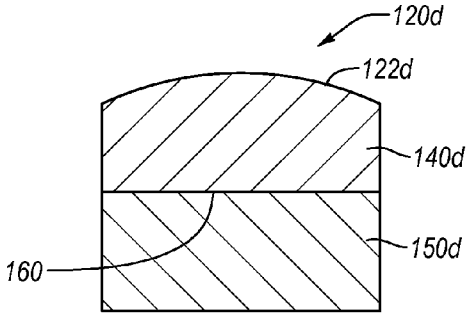
FIG. 2E is a cross-sectional view of a superhard stud element according to an embodiment.

As illustrated in FIG. 2E, embodiments also may include a superhard stud element 120*d* that has a superhard table 140*d* that with a generally dome-shaped or convex working surface 122*d*. In an embodiment, the dome-shaped working surface 122*d* may be at least partially spherical. Except as otherwise described herein, the superhard stud element 120*d* and its materials, components, or elements (e.g., superhard tables) may be similar to or the same as any of the superhard stud elements 120, 120*a*, 120*b*, 120*c* (FIGS. 2A-2D) and their respective materials, components, or elements. For example, the superhard table 140*d* may be bonded or secured to a substrate 150*d*.

In an embodiment, the convex working surface 122*d* may have an outward-facing or convex shape. The working surface 122*d* may have any suitable radius or other arcuate shape, which may vary from one implementation to the next. In any event, similar to the conical working surface 122*c* (FIG. 2D), the convex working surface 122*d* may provide points or areas on the crushing exterior that may exert higher force onto the stock material than other areas on the crushing exterior.

Moreover, in an embodiment, increasing the radius of the convex shape may possibly decrease the size of the pieces or particles of the crushed material produced by the crushing exteriors that include the dome-shaped working surface 122*d*. Conversely, it is believed that decreasing the radius of the convex working surface 122*d* may increase the size of the particles or pieces of the crushed material that may be produced by the crushing exteriors that include one or more superhard stud elements 120*d* with dome-shaped working surfaces 122*d*. Consequently, the average size of the particles and pieces of the crushed material may be adjusted by selecting or adjusting the radius of the working surface 122*d* of the superhard stud element 120*d*.

Figure 2F:
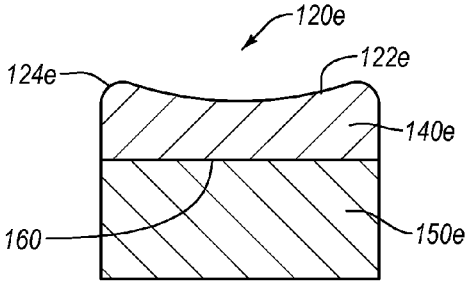
FIG. 2F is a cross-sectional view of a superhard stud element according to yet one other embodiment.

Embodiments also may include a superhard stud element 120*e* that has a superhard table 140*d* having a concave working surface 122*e* as shown in FIG. 2F. Except as otherwise described herein, the superhard stud element 120*e* and its materials, components, or elements (e.g., superhard tables) may be similar to or the same as any of the superhard stud elements 120, 120*a*, 120*b*, 120*c*, 120*d* (FIGS. 2A-2E) and their respective materials, components, or elements. In one embodiment, the shape of the concave working surface 122*e* may be an approximately part spherical, concave recess in the superhard table 140*e*. Furthermore, the superhard stud element 120*e* may include a fillet or radius 124*e*, which may form uppermost portion(s) of the concave working surface 122*e*.

Accordingly, similar to the convex working surface 122*d* (FIG. 2E), the concave working surface 122*e* may produce points or areas on the crushing exterior that may exert higher force onto the solid objects of the stock material than other areas on the crushing exterior. In contrast to the convex working surface 122*d* (FIG. 2E), however, the high force areas produced by the concave working surface 122*e* may be located or positioned about the perimeter of the superhard stud elements 120*e*. Thus, for instance, the pieces or particles crushed by the concave working surface 122*e* may have a maximum size that is less than the perimeter of the concave working surface 122*e*, which may be at least in part formed by the radius 124*e*. As such, it is believed that to increase the maximum and/or average size of the pieces and particles of the crushed material, the perimeter of the concave working surface 122*e* may be increased. Conversely, to decrease the size of the pieces and pieces of the crushed material, the perimeter of the concave working surface 122*e* may be decreased.

Figure 3A:
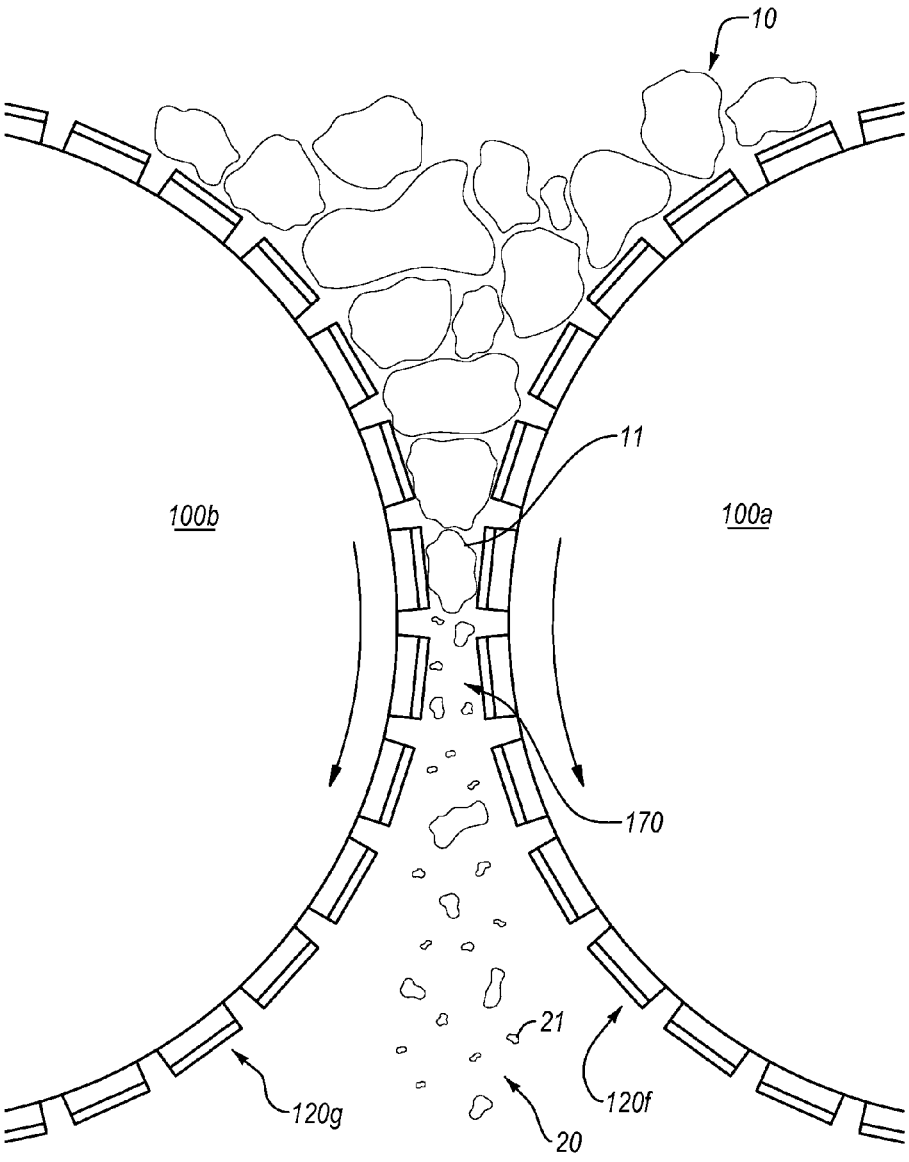
FIG. 3A is a side view of opposing roll assemblies in a first position during operation of processing stock material according to an embodiment.
Figure 3B:
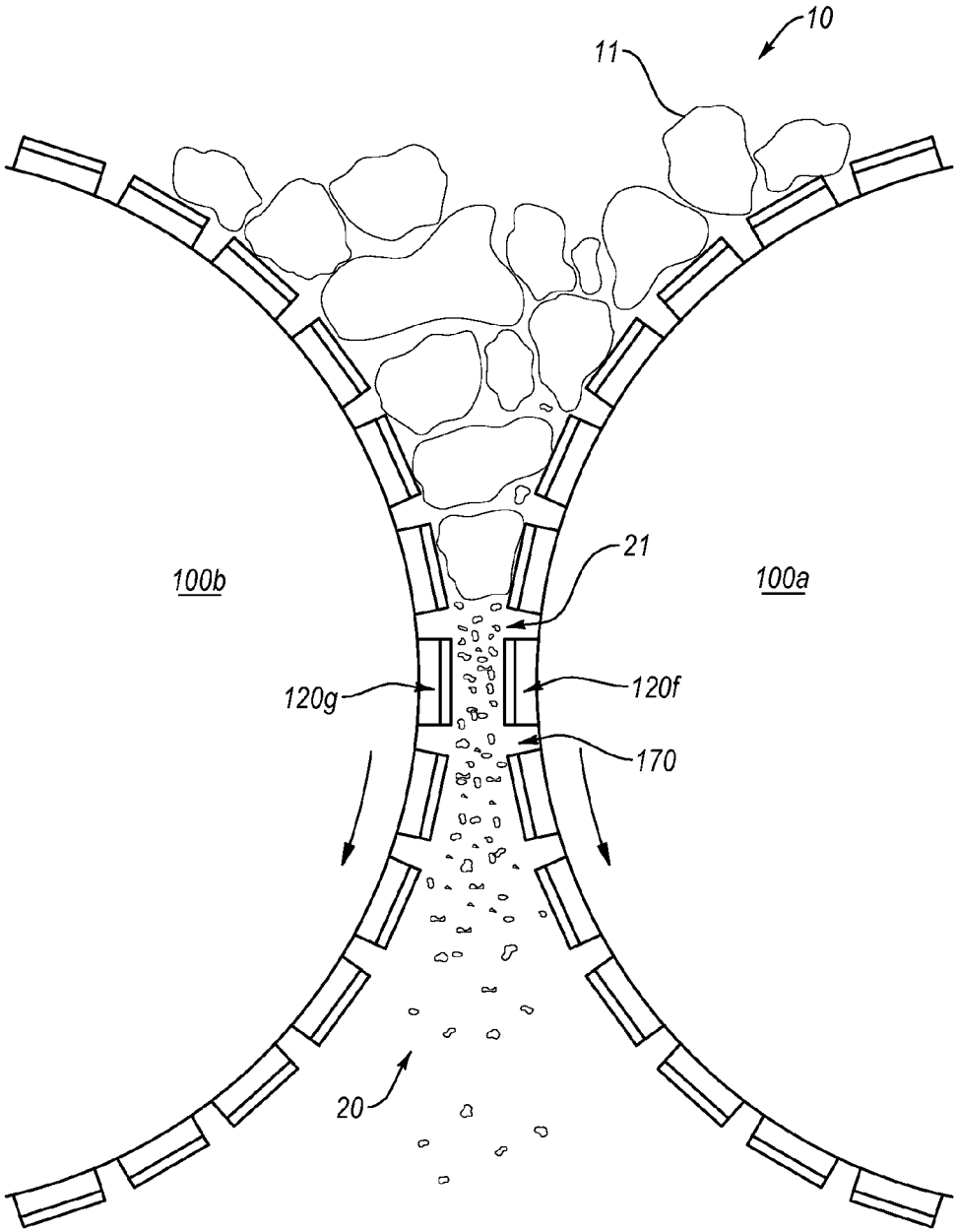
FIG. 3B is a side view of opposing roll assemblies in a second position during operation of processing stock material according to an embodiment.

In any case, as mentioned above, the superhard stud elements may be included in and may form or define at least a portion of one or more crushing exteriors. In an embodiment, both opposing crushing exteriors include superhard stud elements. In some embodiments, superhard stud elements may form substantially the entire crushing exterior. FIGS. 3A and 3B illustrate roll assemblies roll assemblies 100*a*, 100*b* that have crushing exteriors that include superhard stud elements 120*f*, 120*g*, respectively. Particularly, the crushing exteriors at least partially formed or defined by the superhard stud elements 120*f*, 120*g* may be aligned relative to each other and sized and configured to process the stock material in a manner described herein. In an embodiment, except as otherwise described below, the roll assemblies 100*a*, 100*b* and their respective materials, elements, or components may be similar to or the same as the materials, elements, or components, of the roll assembly 100 (FIG. 1). Additionally, any of the superhard stud elements 120*f*, 120*g* and their respective materials, elements, or components may be similar to or the same as any of the superhard stud elements 120, 120*a*, 120*b*, 120*c*, 120*d*, 120*e* (FIGS. 2A-2F) and their respective materials, elements, or components.

As illustrated in FIG. 3A, stock material 10 may be fed between the roll assemblies 100*a* and 100*b*. As the stock material 10 passes through a gap 170 between the roll assembly 100*a* and the roll assembly 100*b*, the opposing crushing exteriors of the roll assemblies 100*a*, 100*b* may compress, crush, break, shear, shred, grind the stock material 10 to produce crushed material 20, or combinations thereof. In an embodiment, the crushing exterior of the roll assembly 100*a* includes the superhard stud elements 120*f* Similarly, the crushing exterior of the roll assembly 100*b* may include the superhard stud elements 120*g*. In an embodiment, as solid objects 11 pass between the roll assemblies 100*a*, 100*b*, the superhard stud elements 120*f* and the superhard stud elements 120*g* may reduce the solid objects 11 to smaller particles or pieces 21, included in the crushed material 20.

In an embodiment, the roll assembly 100*a* may rotate in a counterclockwise direction while the roll assembly 100*b* may rotate in a clockwise direction. Accordingly, as the stock material 10 is fed between the roll assembly 100*a* and the roll assembly 100*b*, the stock material may move into the gap 170 between the roll assemblies 100*a*, 100*b*. Furthermore, as illustrated in FIG. 3B, the superhard stud elements 120*f*, 120*g* may reduce the size of the stock material 10 (e.g., solid objects 11) and produce the pieces 21 of the crushed material, in a manner described above.

It should be appreciated that the particular mechanism of reducing the size of the stock material 10 (e.g., crushing, breaking (including inter-particle breaking), compressing, shearing, shredding, grinding, or combinations thereof) as well as the particular average size of the particles 21 of the crushed material 20 may vary from one embodiment to the next. For instance, the mechanism of reducing the size of the solid objects 11 and/or the size of the pieces 21 produced therefrom may depend, among other things, on the geometry of the superhard stud elements 120*f*, 120*g*, the size of the gap 170, the size of the roll assemblies 100*a*, 100*b* (e.g., length to diameter ratio), the properties of the stock material 10, relative speeds of rotation of the roll assemblies 100*a*, 100*b*, or combinations thereof. In any event, however, the stock material 10 may be passed between one or more of the roll assemblies 100*a*, 100*b* and may be reduced to the pieces 21 of desired size.

Figure 4:
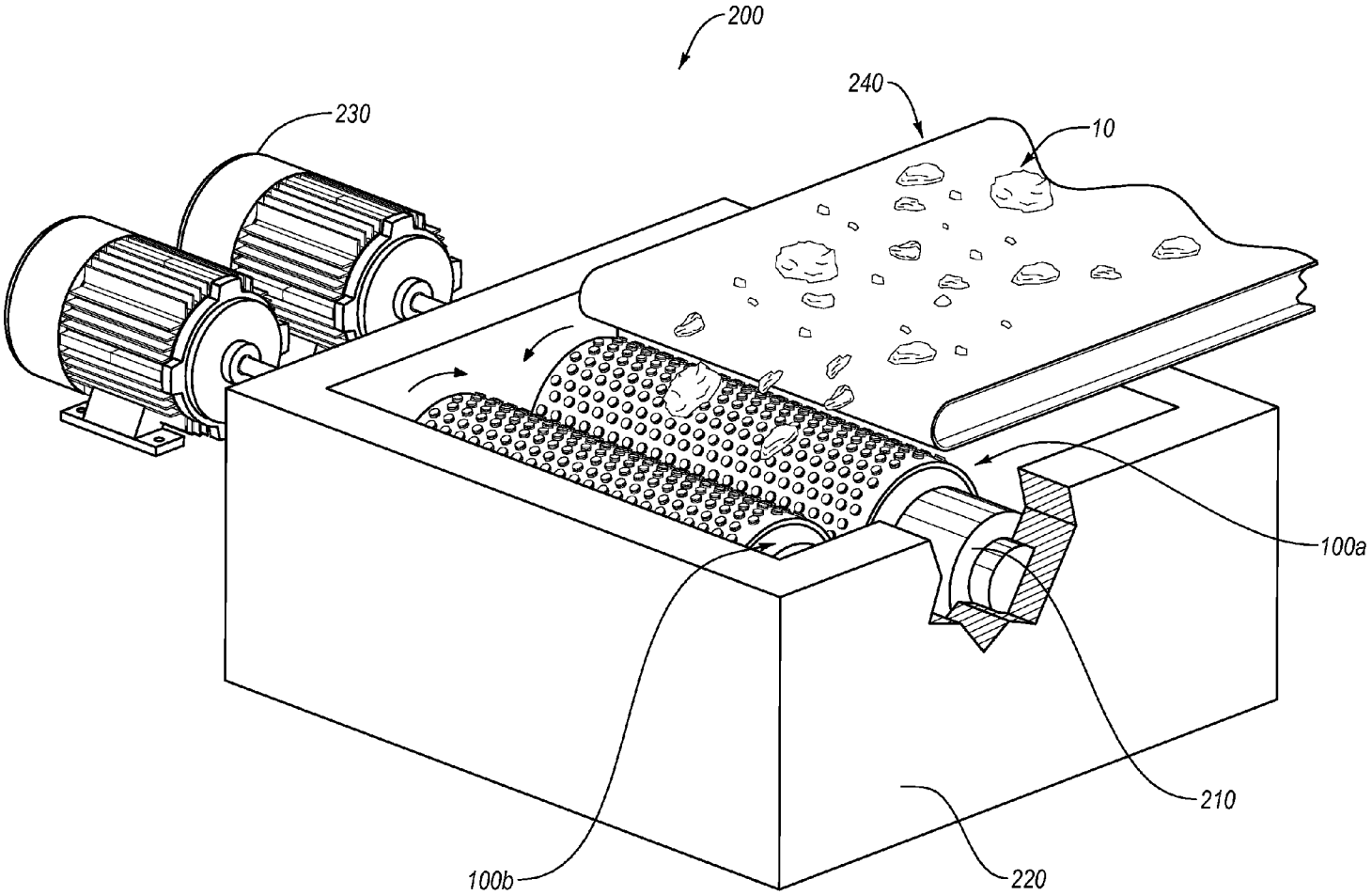
FIG. 4 is an isometric view of a HPGR apparatus according to an embodiment.

In an embodiment, as illustrated in FIG. 4, the roll assembly 100*a* and roll assembly 100*b* may be included in an HPGR apparatus 200. In an embodiment, each of the roll assembly 100*a* and roll assembly 100*b* may include a shaft, such as a shaft 210. The shaft 210 may rotatably secure the roll assembly 100*a* and/or the roll assembly 100*b* to and/or within a housing 220 of the HPGR apparatus 200. For instance, the shaft 210 and/or the housing 220 may include one or more bearings (e.g., radial bearings, tapered bearings, journal bearings, etc.) that may rotatably secure the shaft 210 to the housing 220. It should be appreciated that in some embodiments, one of the roll assemblies 100*a* or 100*b* may remain stationary (e.g., may be fixedly mounted in the housing 220).

Additionally or alternatively, the HPGR apparatus 200 may include motors 230 that are each operably coupled to and rotate the roll assembly 100*a* and/or roll assembly 100*b* in opposite directions, which may generate relative movement of the opposing crushing exteriors of the roll assembly 100*a* and roll assembly 100*b*. In some embodiments, however, the roll assembly 100*a* and roll assembly 100*b* may be rotated in the same direction but at different speeds. For example, the roll assembly 100*a* may be rotated in a counterclockwise direction at a first speed, while the roll assembly 100*b* may be rotated in the counterclockwise direction at a second speed (e.g., the first speed may be greater than the second speed). In any case, the stock material 10 may be fed between the roll assembly 100*a* and the roll assembly 100*b* of the HPGR apparatus 200, which may produce the crushed material, in a manner described above.

In some embodiments, the HPGR apparatus 200 also may include a material delivery system 240, which may deliver the stock material 10 to a desired location, such as to or near a location of the roll assemblies 100*a* and 100*b*, such that the stock material 10 may be processed by the roll assemblies 100*a* and 100*b*. In an embodiment, the delivery system 240 may be a conveyor or a belt that may transfer the stock material 10 to or near a desired location in the HPGR apparatus 200, such as at the roll assembly 110*a* or between the roll assembly 110*a* and 110*b*. In alternative or additional embodiments, the delivery system 240 may be a chute or other channel that may deliver the stock material 10 to a desired location in the HPGR apparatus 200. The stock material 10 also may be delivered by a cart, overhead crane (e.g., via a carriage), a hopper, and any number of suitable delivery systems 240.

In some instances, the stock material 10 may be unprocessed (e.g., the stock material 10 may come directly from a mine) and may be carried by the delivery system 240 for processing by the HPGR apparatus 200. Alternatively, at least a portion of the stock material 10 may be preprocessed before being delivered to the HPGR apparatus 200. For example, solid objects making up at least a portion of the stock material 10 may be reduced in size to a desired size of average size, to facilitate further processing by the HPGR apparatus 200. In any event, the stock material 10 may be processed by the HPGR apparatus 200 to produce crushed material having particles or pieces of a particular or desirable average size.

While various aspects and embodiments have been disclosed herein, other aspects and embodiments are contemplated. The various aspects and embodiments disclosed herein are for purposes of illustration and are not intended to be limiting. Additionally, the words "including," "having," and variants thereof (e.g., "includes" and "has") as used herein, including the claims, shall have the same meaning as the word "comprising" and variants thereof (e.g., "comprise" and "comprises").

The invention claimed is:

1. A roll assembly for reducing size of a stock material, the roll assembly comprising:

a roll body having an outer surface and having a plurality of recesses in the outer surface; and a plurality of superhard stud elements each of which is positioned inside a corresponding one of the plurality of recesses and brazed to the roll body, at least some of the plurality of superhard stud elements projecting outwardly from the outer surface of the roll body, the at least some of the plurality of superhard stud elements including:

a tungsten carbide substrate; and a polycrystalline diamond table bonded to the tungsten carbide substrate, the polycrystalline diamond table including a convex working surface;

wherein the convex working surfaces of the at least some of the plurality of superhard stud elements at least partially define a crushing exterior of the roll assembly; and a plurality of tungsten carbide stud elements secured to the roll body and at least partially defining the crushing exterior, each of the plurality of tungsten carbide stud elements including a tungsten carbide working surface at least some of the plurality of tungsten stud elements projecting outwardly from the outer surface of the roll body.

2. The roll assembly of claim 1, wherein the plurality of superhard stud elements spiral about the outer surface of the roll body.

3. The roll assembly of claim 1, wherein the plurality of superhard stud elements define a plurality of spaced rows of the plurality of superhard elements.

4. The roll assembly of claim 1, wherein the plurality of superhard stud elements are substantially uniformly spaced from each other.

5. The roll assembly of claim 1, wherein the polycrystalline diamond table is at least partially leached.

6. The roll assembly of claim 1, wherein the working surface includes a texture configured to increase friction between the convex working surface and the stock material.

7. A high pressure grinding roll ("HPGR") apparatus for processing a stock material, comprising:

a first roll assembly including a first crushing exterior, the first roll assembly including:

a roll body; and a first plurality of superhard stud elements brazed to the roll body, each of the first plurality of superhard stud elements including a substrate bonded to a polycrystalline diamond table including a first working surface, the first working surfaces of the first plurality of superhard stud elements at least partially forming the first crushing exterior, at least some of the first plurality of superhard stud elements projecting outwardly from the first roll body;

a second roll assembly positioned adjacent to the first roll assembly to define a gap therebetween, the second roll assembly including a second roll body and a second plurality of stud elements each of which includes a second working surface, the second working surfaces of the second plurality of stud elements forming a second crushing exterior, at least some of the second plurality of superhard stud elements projecting outwardly from the second roll body;

a motor connected to and configured to rotate at least one of the first roll assembly or the second roll assembly; and wherein at least one of the first roll assembly or the second roll assembly includes a third plurality of stud elements that at least partially define a corresponding one of the first crushing exterior or the second crushing exterior, each of the third plurality of stud elements including a tungsten carbide working surface, at least some of the third plurality of stud elements projecting outwardly from the first roll body or the second roll body.

8. The HPGR apparatus of claim 7, wherein the first working surface of each of the first plurality of superhard stud elements is substantially planar or non-planar.

9. The HPGR apparatus of claim 7, wherein the first plurality of superhard elements spiral about a rotation axis of the first roll assembly.

10. The HPGR apparatus of claim 7, wherein the first plurality of superhard elements define a plurality of spaced rows of the first plurality of superhard elements.

11. The HPGR apparatus of claim 7, wherein the first plurality of superhard elements are substantially uniformly spaced from each other.

12. The HPGR apparatus of claim 7, further comprising a material delivery system configured to deliver the stock material to a location at or near at least one of the first or second roll assemblies.

13. A method of processing a stock material, the method comprising:

rotating a first plurality of stud elements about a first axis in a first direction, at least some of the first plurality of stud elements includes a substrate brazed to a first roll body and bonded to a polycrystalline diamond table that has a first convex working surface, the at least some of the first plurality of stud elements projecting outwardly from the first roll body;

rotating a second plurality of stud elements about a second axis in a second direction, at least some of the second plurality of stud elements including a substrate brazed to a second roll body and bonded to a polycrystalline diamond table that has a second convex working surface, the at least some of the second plurality of stud elements projecting outwardly from the second roll body;

reducing the size of the solid object included in the stock material by contacting the stock material with the first convex working surfaces and the second convex working surfaces; and wherein at least one of the first plurality of stud elements includes stud elements including a tungsten carbide working surface or the second plurality of stud elements includes stud including a tungsten carbide working surface.

14. The method of claim 13, wherein the first direction is opposite to the second direction.

* * * * *

UNITED STATES PATENT AND TRADEMARK OFFICE

CERTIFICATE OF CORRECTION

PATENT NO. : 9,492,827 B2
APPLICATION NO. : 14/266353
DATED : November 15, 2016
INVENTOR(S) : Grant Kyle Daniels and Regan Leland Burton It is certified that error appears in the above-identified patent and that said Letters Patent is hereby corrected as shown below:

On the Title Page

In the Abstract, Line 3, "the roll assemblies of may improve" should read as -- the roll assemblies may improve --

In the Claims

In Claim 1, Column 14, Lines 38-39, "elements including a tungsten carbide working surface at least some of the plurality of tungsten stud elements" should read as -- elements including a tungsten carbide working surface, at least some of the plurality of tungsten stud elements --

In Claim 13, Column 16, Line 9, "stud elements includes a substrate" should read as -- stud elements including a substrate --

In Claim 13, Column 16, Lines 28-30, "the second plurality of stud elements includes stud including a tungsten carbide" should read as -- the second plurality of stud elements includes a tungsten carbide --

Signed and Sealed this
Twenty-seventh Day of June, 2023

Katherine Kelly Vidal

Katherine Kelly Vidal
*Director of the United States Patent and Trademark Office*